United States Patent [19]

Matus

[11] Patent Number: 4,781,359

[45] Date of Patent: Nov. 1, 1988

[54] SUB ASSEMBLY FOR A SWIVEL

[75] Inventor: Wayne L. Matus, Gainesville, Tex.

[73] Assignee: National-Oilwell, Houston, Tex.

[21] Appl. No.: 100,158

[22] Filed: Sep. 23, 1987

[51] Int. Cl.[4] ..... F16F 1/06

[52] U.S. Cl. ..... 267/71; 166/77.5; 267/125; 267/226; 267/291; 464/169

[58] Field of Search ..... 267/70, 71, 72, 125, 267/226, 64.18, 64.22, 291, 221, 34; 464/18, 20, 169; 166/77.5

[56] References Cited

U.S. PATENT DOCUMENTS

| | | | |
|---|---|---|---|
| 2,058,186 | 10/1936 | Spalding | 294/82 |
| 2,070,563 | 2/1937 | Cusack | 267/70 X |
| 2,636,726 | 4/1953 | Mercier | 267/226 X |
| 2,712,932 | 7/1955 | Gould | 267/70 |
| 3,464,507 | 9/1969 | Alexander et al. | 175/85 |
| 3,662,842 | 5/1972 | Bromell | 173/1 |
| 3,766,991 | 10/1973 | Brown | 173/20 |
| 3,792,787 | 2/1974 | Maloney | 214/152 |
| 3,915,244 | 10/1975 | Brown | 175/85 |
| 4,498,698 | 2/1985 | Zimmerman | 294/82 R |
| 4,529,045 | 7/1985 | Boyadjieff et al. | 173/164 |
| 4,552,230 | 11/1985 | Anderson et al. | 267/125 X |
| 4,593,773 | 6/1986 | Skeie | 175/85 |
| 4,600,062 | 7/1986 | Tang | 267/125 X |
| 4,697,798 | 10/1987 | Piaer et al. | 267/70 |

*Primary Examiner*—George E. A. Halvosa

*Attorney, Agent, or Firm*—R. J. Bunyard; L. A. Fillnow; R. H. Johnson

[57] ABSTRACT

A sub assembly for connecting a power swivel to a drill string. The assembly includes a telescopic sub having a preloaded spring. The telescopic sub has three discrete positions enabling it to travel in either direction from a normal position. This capability prevents thread damage for both when connecting and disconnecting a drill pipe to the drill string.

9 Claims, 4 Drawing Sheets

SUB ASSEMBLY FOR A SWIVEL

BACKGROUND OF THE INVENTION

This invention relates to a sub assembly for connecting a swivel of a drilling unit to a drill string. More specifically, the sub assembly includes a telescopic sub having a preloaded spring. The telescopic sub has three discrete positions allowing it to travel in either direction from a normal position when threading in or out of a connection.

Conventional rotary drilling requires the use of a rotary table, a motor for rotating the table, a kelly and kelly bushings. These drilling systems are being replaced by "top drive" drilling systems which rotate the drill string from above using a drilling motor suspended from or incorporated with a swivel.

Such a power swivel can be installed in a standard derrick or mast. Drilling is accomplished by the powered rotation of a suspended string of drill pipe. A cutting tool or bit is at the bottom end of the drill string which, through the rotational energy supplied by the power swivel, cuts through the earth's formations and deepens the well. As the well is drilled, sections or stands of drill pipe must be periodically added to the top end of the drill string. During the drilling of deep wells, such as oil wells, the drill bit may become worn and/or require replacement before drilling of the well is completed. In this situation the entire drill string must be withdrawn from the well, one stand of pipe at a time, and the drill bit replaced. After a new drill bit is replaced at the bottom end of the stand of drill pipe, the drill string is reassembled as described above. For drilling equipment utilizing a power swivel, the pipe handling operation is remotely controlled from a console on the derrick platform. Because the drilling unit is large and somewhat cumbersome to handle, the threads on the pipe ends frequently become damaged when "spinning in" or "spinning out" the individual pipe stands from the drill string. When the pipe threads become damaged, the pipe must be temporarily taken out of service until the threads can be remachined to serviceable condition. Pipe having damaged threads and not taken out of service for repair could result in a separation of the drill string inside the well bore. This increases the costs of drilling because of delay time and the increased inventory of drill pipe required.

When a drill bit must be replaced, the power swivel vertically lifts the drill string from the well a distance above the floor of the drilling rig corresponding to the length of a stand of pipe. The stand of drill pipe may include as many as three sections of pipe. The weight of the drill string is then supported by wedges or slips located at the floor of the drilling rig. The tongs of pipe handling equipment are used to hold and prevent rotation of the drill string while simultaneously rotating or "spinning out" the top stand of pipe. This top stand of pipe is supported by the power swivel as the power swivel rotates the stand of pipe. As the stand of pipe becomes threadably disengaged from the drill string, the tension of the power swivel causes the stand of pipe to be abruptly pulled away. However, the bottom end of the stand of pipe frequently is impacted against the top end of the drill string caused by the rebound of the abrupt disengagement. Similar rebound and impact may occur when disconnecting the sub assembly of the power swivel from the top end of the pipe. Thread damage may occur when reassembling the stands of pipe to the drill string. The operator's visibility may be partially obscured when lowering a stand of pipe using the power swivel and the control means lacks sensitivity to prevent sudden impact when engaging the bottom end of the stand of pipe to the top end of the drill string during the "spinning in" operation. For a stand of pipe extending as much as 90 feet (27.4 m) above the console, the operator's line of sight may be completely obscured when connecting the sub assembly of the power swivel to the upper end of the stand of pipe.

There have been many attempts over the years to provide cushioning devices to prevent impact and thread damage when "spinning out" or "spinning in" pipe to a drill string. However, these devices do not provide cushioning or thread protection when connecting and disconnecting a swivel sub assembly to a drill string. More importantly, these cushioning devices have not completely eliminated impacts because thread damage still occurs. U.S. Pat. No. 2,712,932 discloses a telescoping cushioning device including a helical compression spring positioned within a cylinder. The cylinder is positioned at the top end of a pipe to be connected to a drill string. The spring yields or is compressed by the weight of the pipe so that the lower end of the pipe can be connected to the drill string without danger of thread damage. U.S. Pat. No. 3,766,991 discloses a power swivel utilizing shock absorbers enabling smooth handling of pipe. The hangers for the swivel are formed by hydraulic cylinders so that upward movement of the power swivel resulting when the pipe section is threaded is compensated for by the downward movement of a piston under the cushioning pressure of a fluid. This assures smooth release of the threads without sudden upward movement of the power swivel when the threads and released. U.S. Pat. No. 4,593,773 discloses a drilling assembly including a top driven rotary device. The rotary device is connected to a drill string using a telescopic shaft. When a pipe is hoisted by the rotary device, hydraulic fluid is exhausted from external hydraulic cylinders allowing pipe supporting hangers to be pulled downwardly.

Nevertheless, the above described cushioning or telescopic devices do not eliminate the impact problem and provide the same degree of thread protection during both pipe handling situations discussed above. There remains a long-felt need for a device which eliminates impact and thread damage both when making and breaking connections to drill pipe and a sub assembly. My invention overcomes this problem by providing a sub assembly including a spring loaded telescopic sub having three discrete positions. The sub can travel in either direction from its normal position. When a swivel is lowered by a support means for connection to a drill pipe, the sub will travel upwardly relative to the swivel when the sub is lowered into contact with the drill pipe. When the swivel is connected to the drill pipe, the make-up of the threads causes the sub to travel downwardly relative to the swivel thereby compressing the spring. When the sub is disconnected from the drill pipe, expansion of the spring causes the sub to be pulled away from the drill pipe when the threads are disengaged as the sub moves upwardly relative to the drill pipe back to its normal position.

BRIEF SUMMARY OF THE INVENTION

This invention relates to a sub assembly including a telescopic sub positioned between upper and lower threaded pins, the lower pin for threadable connection to a drill pipe and the upper pin for threadable connection to a swivel. The telescopic sub includes an annular inner sleeve and an annular outer sleeve outwardly spaced from the inner sleeve. The inner and outer sleeves are connected to the upper pin. The outer sleeve includes a load bearing shoulder on its inside surface. An annular shiftable member is disposed within a first chamber defined by the two sleeves and the upper pin. The outer surface of the shiftable member includes an annular surface, a piston, and a recess. The outer diameter of the annular surface is no greater than the inner diameter of the load bearing shoulder of the outer sleeve. The outer diameter of the piston is greater than the inner diameter of the load bearing shoulder of the outer sleeve with the piston being shiftably connected to the inner surface of the outer sleeve. The recess includes an upper shoulder and an outer diameter less than the outer diameter of the annular surface. An annular shiftable retainer is outwardly spaced from the outer sleeve with a preloaded spring disposed within a second chamber provided therebetween. The lower end of the retainer has an inner diameter less than the outer diameter of the annular surface. The piston has a normal or first position, a second or compressed position, and a third or extended position. When the piston is in the normal or first position, the lower end of the retainer engages the upper shoulder of the recess. When the lower pin of the sub assembly contacts the upper end of a drill pipe, the shiftable member and the lower pin are upwardly displaced relative to the drill pipe. The maximum distance of travel to the second position is the distance between the piston in its normal position and the bottom surface of the upper pin. When the lower pin is connected to a drill pipe, the shiftable member is pulled downwardly thereby compressing the spring until the piston contacts the load bearing shoulder of the outer sleeve. The piston is now in the third position. When the sub assembly is rotated and disconnected from the drill pipe, expansion of the spring causes the shiftable member to be upwardly displaced back to the normal position thereby pulling the lower pin away from the upper end of the drill pipe.

It is a principal object of my invention to provide an improved sub assembly which will eliminate pipe impact resulting in thread damage when connecting or disconnecting a sub assembly to a drill pipe.

Another object of my invention is to provide an improved sub assembly which will eliminate pipe impact resulting in thread damage when connecting a drill pipe to a drill string.

An advantage of my invention is reduced drilling costs by minimizing delays for removing damaged pipe, minimizing thread requiring machining and reduced pipe inventory.

The above and other objects, features and advantages of my invention will become apparent upon consideration of the detailed description and appended drawing.

DETAILED DESCRIPTION OF THE PREFERRED EMBODIMENT

Figure 1:
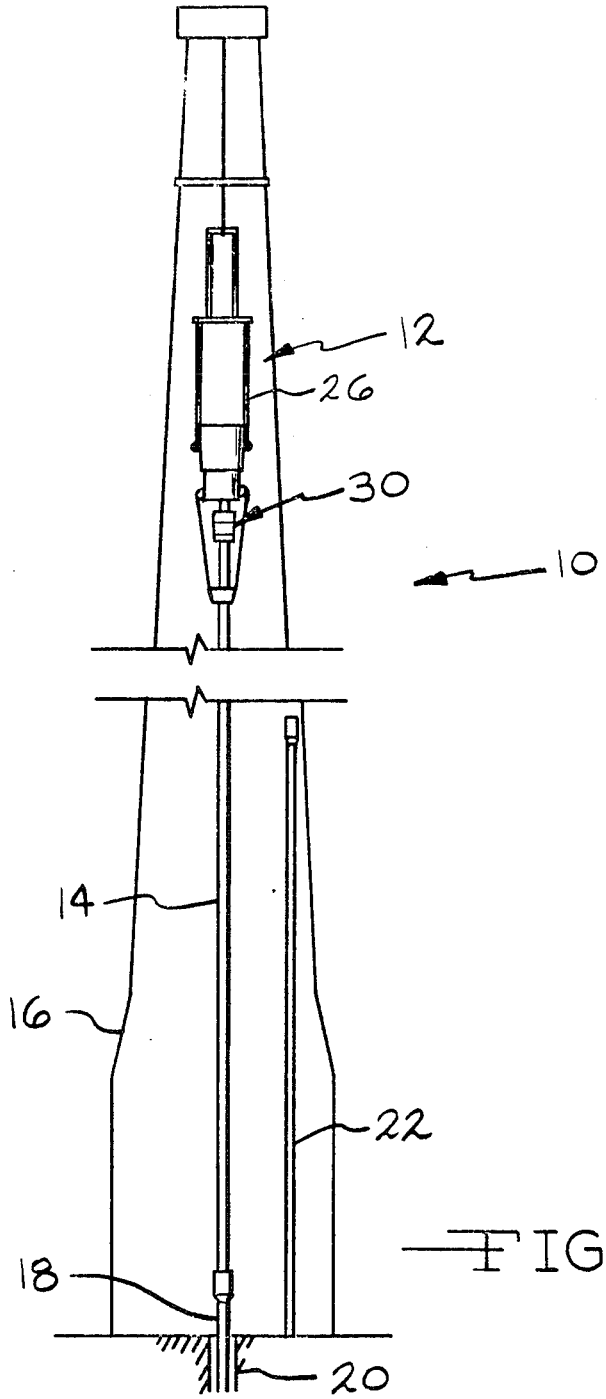
FIG. 1 is a schematic elevational view showing a conventional drilling unit ultilizing a power swivel incorporating my invention.

Referring to FIG. 1, the reference numeral 10 denotes a drilling unit including a means 12 for supporting a stand of drill pipe 14 within a derrick 16. Derrick 16 is positioned over a drill string 18 in a well 20. Stand of pipe 14 may include as many as three sections of pipe. If each section is 30 foot (9.1 m) long, a stand of pipe could be about 90 foot (27.4 m). Stands of pipe 22 are temporarily stored in a pipe rack (not shown) as needed when adding pipe to drill string 18 or removing drill string 18 to replace a worn drill bit.

Figure 2:
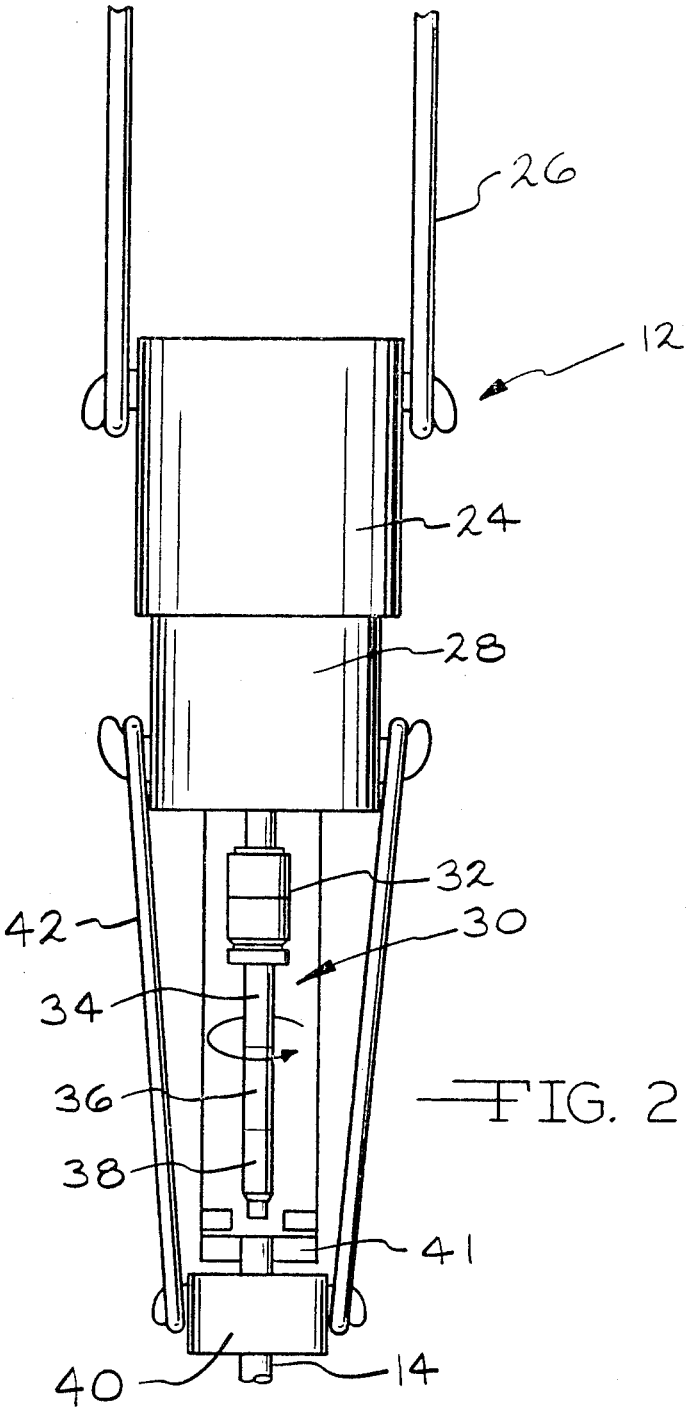
FIG. 2 is a schematic view of the support means of FIG. 1.

FIG. 2 illustrates conventional support means 12 including a drill motor 24 suspended from a pair of arms 26. A sub assembly 30 incorporating my invention is connected to drill motor 24 through a swivel 28. Sub assembly 30 includes a telescopic sub 32, a packing sub 34, a kellycock 36, and a saver sub 38. Pipe 14 is held by an elevator 40 suspended from a pair of arms 42. Power swivel grabs or tongs 41 prevent rotation of pipe 14 while assembly 30 is rotated by drill motor 24 for connection to pipe 14.

Figure 3:
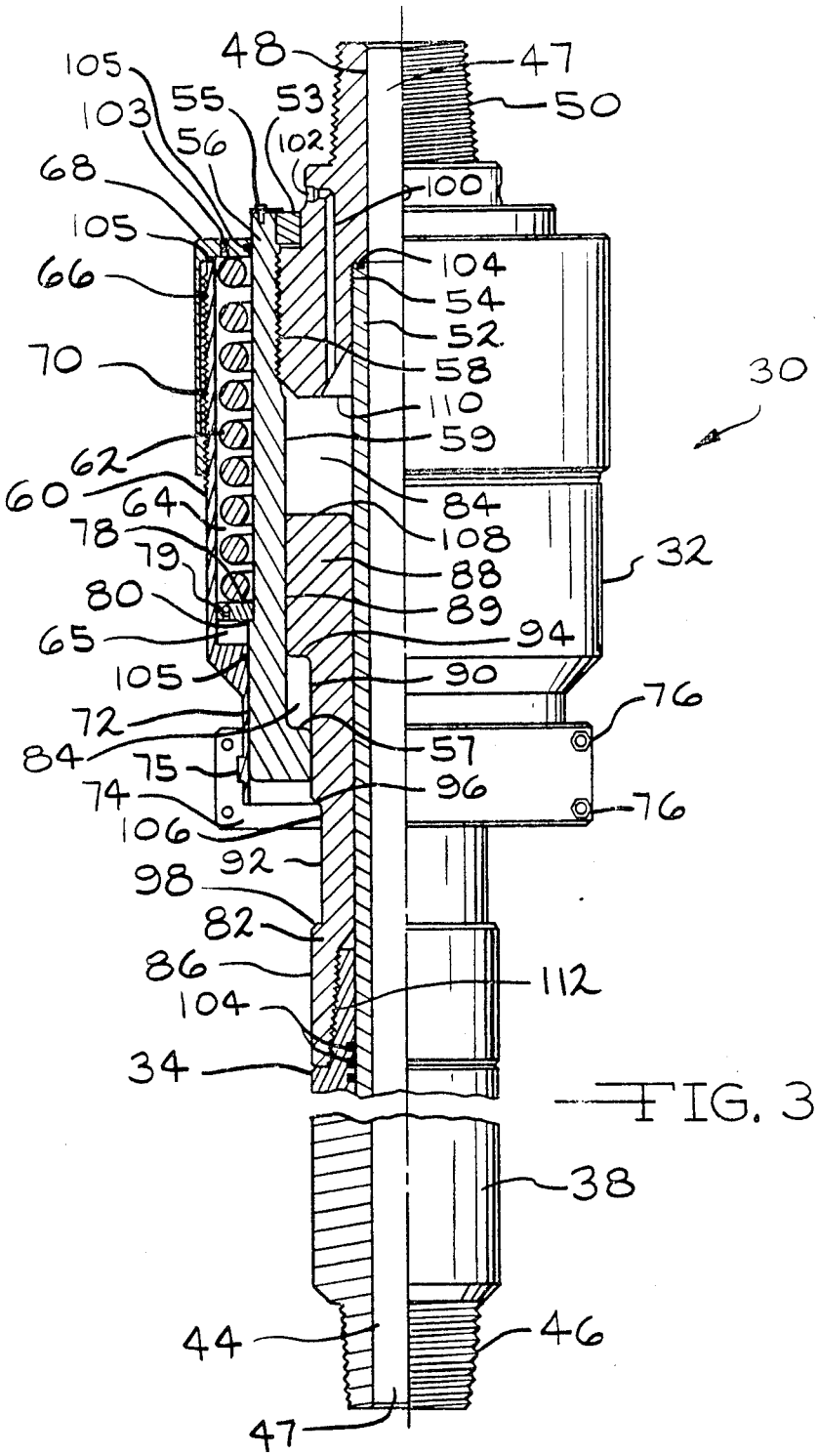
FIG. 3 is a view in partial section showing detail of a preferred embodiment of my invention.

FIG. 3 shows a preferred embodiment of my sub assembly 30. Assembly 30 includes telescopic sub 32 axially disposed between a lower pin 44 threaded at 46 and an upper pin 48 threaded at 50. Upper pin 48 is threaded for connection to swivel 28 and lower pin 44 is threaded for connection to pipe 14. Assembly 30 includes a through bore 47 for passing drilling fluid down through the drill string and into the well during drilling. Telescopic sub 32 includes an annular inner sleeve 52 and an outwardly spaced annular sleeve 56. Inner sleeve 52 is rigidly connected to the lower inside portion of pin 48 by threads 54. Outer sleeve 56 is also rigidly connected to the lower outside portion of pin 48 at threads 58. A ring 53 and a fastener 55 lock pin 48 to outer sleeve 56 and prevent unthreading. Lower inside surface 59 of sleeve 56 includes a load bearing shoulder 57. An annular shiftably mounted retainer 60 is outwardly spaced from sleeve 56. A preloaded spring 62 is disposed in a cylindrical chamber 64 formed between retainer 60 and sleeve 56. Upper end 66 of retainer 60 is closed by a retaining cap 68 connected at threads 70. Lower end 72 of retainer 60 is closed by a retaining cap 74 held by fasteners 76. Cap 74 is connected to retainer 60 by an annular ring 75. Spring 62 is supported by a ring 78 which abutts against a shoulder 80 on the outer surface of sleeve 56. Ring 78 includes an orifice 79.

A shiftable member 82 is disposed in a cylindrical chamber 84 formed between inner sleeve 52, outer sleeve 56 and upper pin 48. Outer surface 86 of shiftable member 82 includes a piston 88, an annular surface 90 and a recess 92. Piston 88 includes a lower shoulder 94, an upper stop surface 108, and has grooves for being shiftably connected to splines on inner surface 59 of sleeve 56. These splines and grooves are lubricated through a passageway 100 via a grease fitting 102. Recess 92 includes an upper shoulder 96 and a lower shoulder 98. Seals 104 prevent drilling fluid from entering chamber 84 and seals 105 prevent fluid from escaping from spring chamber 64 and a fluid chamber 65 formed below ring 78.

Now I will describe the operation of telescopic sub 32. As indicated above, telescopic sub 32 has three discrete positions each of which functions to eliminate thread damage during the tripping operation when adding or removing pipe from a drill string. In FIG. 3, piston 88 is shown in approximately the middle of chamber 84. This is the normal or first position of shiftable member 82. Spring 62 is preloaded with a force to support the weight of member 82, packing sub 34, kellycock 36, and saver sub 38 to establish this position. Cap 74 has a surface 106 having an inside diameter less than that of the outer diameter of annular surface 90 thereby allowing surface 106 to be received between shoulders 96 and 98 of recess 92. Under the influence of the preload, spring 62 urges retainer 60 upwardly relative to sleeve 56 causing surface 106 of cap 74 to pull upwardly against shoulder 96. This upward urging against shoulder 96 by surface 106 urges piston 88 of shiftable member 82 upwardly as shown in chamber 84.

Pipe 14 is secured by elevator 40 and lowered by support means 12 to drill string 18. Support means 12 simultaneously lowers the power swivel in derrick 16 for connecting pin 44 of saver sub 38 to the upper end of drill pipe 14 and connecting lower end of drill pipe 14 to upper end of drill string 18. The operator's vision is frequently obscured and he cannot precisely determine when pin 44 is about to contact the upper end of drill pipe 14. Furthermore, the control means for operating support means 12 lacks sensitivity to quickly stop the lowering of the power swivel. Sudden impact of thread 46 against a corresponding thread in the box end of drill pipe 14 may cause damage to either of the threads requiring replacement of sub 38 or pipe 14 for rethreading. When using my telescopic sub 32, saver sub 38 shifts upwardly relative to telescopic sub 32 when contact is made with the box end of pipe 14 by an amount corresponding to the upward shift of shiftable member 82. As long as the operator stops the downward travel of support means 12 before stop surface 108 of piston 88 contacts a stop surface 110 of pin 48, damage to the threads will be prevented. As piston 88 shifts upwardly, shoulder 96 pulls away from cap surface 106. This upward displacement of piston 88 is the compressed or second position of shiftable member 82. The length of recess 92 will be at least equal to the travel distance from the first position to the second position to accomodate the upward displacement of member 82 without lower shoulder 98 of recess 92 contacting cap surface 106.

After contact with pipe 14 is made, drill string 18 is held by tongs (not shown) near the floor of derrick 16 to prevent rotation of drill string. Saver sub 38 is rotated by drill motor 24 for connection to pipe 14 and connection of drill pipe 14 to drill string 18 simultaneously. Inner surface 59 of sleeve 56 includes splines (not shown) for slidable engagement with outer surface 89 of piston 88. Rotational energy by drill motor 24 is transmitted through pin 48, sleeve 56, and shiftable member 82 whose lower end is threadably connected at 112 to packing sub 34. As pin 44 is rotated and threaded into the top end of drill pipe 14, member 82 is displaced downwardly to an extended or third position. Support means 12 lowers sub assembly 30 until pin 44 contacts the upper end of pipe 14 but does not have to continue lowering assembly 30 when threading pin 44 to pipe 14. The makeup of threads pulls member 82 downwardly to a fully extended position until shoulder 94 on piston 88 contacts load bearing shoulder 57 on sleeve 56. Shoulder 96 engages surface 106 and simultaneously pulls retainer 60 downwardly. The downward shift by member 82 causes cap 74 via annular ring 75 to pull retainer 60 downwardly thereby compressing spring 62. Spring chamber 64 is filled with oil through an inlet 103. Ring 78 includes orifice 79 so that as retainer 60 is pulled downwardly relative to outer sleeve 56, the oil in chamber 64 passes into chamber 64.

If the drill bit (not shown) at the bottom of drill string 18 becomes damaged and/or worn requiring replacement, drill string 18 must be completely removed from well 20. Support means 12 elevates a portion of drill string 18 corresponding in length to stand of pipe 14 above the derrick floor. Most of the drill string weight is now supported by wedges or slips (not shown) at the derrick floor. Pipe 14 is removed from drill string 18 by first disconnecting saver sub 38 from the top end of pipe 14. Rotation of pipe 14 is prevented by grabs 41 while sub assembly 30 is rotated by drill motor 24. As the threads between saver sub 38 and the upper end of pipe 14 disengage, saver sub 38 is abruptly pulled away from the top end of pipe 14 because of the uplift tension provided by the expansion of spring 62. Without a cushioning device, saver sub 38, packing sub 34, and shiftable member 82 would rebound and saver sub 38 could collide with the upper end of pipe 14. Telescopic sub 32 will not rebound because spring chamber 64 is filled with viscous oil. Passage of oil from chamber 65 through orifice 79 into chamber 64 as retainer 60 shifts upwardly relative to outer sleeve 56 critically dampens any potential rebound. Shiftable member 82 is deliberately shifted upwardly from the third position back to its normal position. Pipe 14 is then rotated relative to drill string 18 for disconnection by a drill pipe spinner (not shown) on the floor of derrick 16.

Alternatively, pipe 14 could be removed from drill string 18 by first disconnecting the bottom end of pipe 14 from the top end of drill string 18. In this sequence, spring 62 must be preloaded to not only support the weight of member 82, packing sub 34, kellycock 36 and saver sub 38 but also support the weight of pipe 14. The preload force on spring 62 will be such so that piston 88 is in its normal position (preferrably in the middle of chamber 84) when pipe 14 is suspended from sub assembly 30. Rotation of drill string 18 is prevented by tongs (not shown) near the floor of derrick 16 while pipe 14 and sub assembly 30 are rotated by drill motor 24. As the threads between pipe 14 and drill string 18 are disengaged, preloaded spring 62 via retainer 60 pulls member 82 upwardly relative to sub assembly 30 from the third position back to the normal position thereby pulling pipe 14 away from drill string 18. As described above, the upward movement of retainer 60 relative to outer sleeve 56 forces oil from chamber 65 back into chamber 64 to critically dampen any rebound and prevent impact of pipe 14 against drill string 18.

Figure 4:
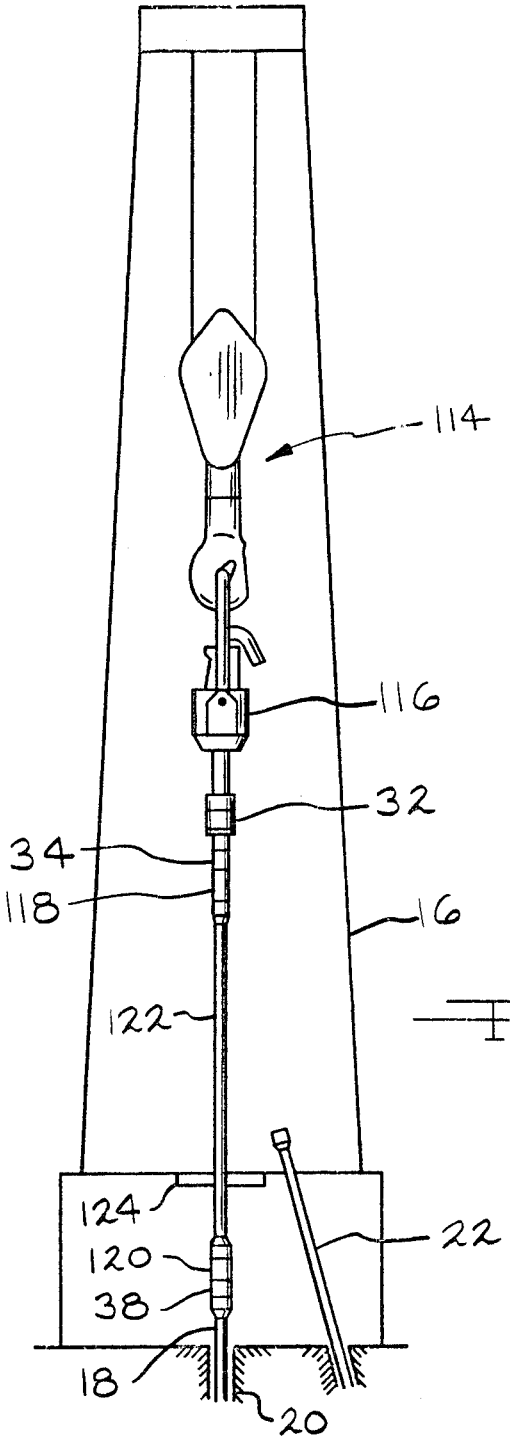
FIG. 4 is a schematic elevational view showing a conventional drilling unit utilizing a rotary table incorporating my invention.

I have described above the use of my sub assembly with a top drive drilling system having a power swivel. FIG. 4 illustrates the use of my sub assembly with a drilling system using a rotary table. Telescopic sub 32 is disposed between a modified drill pipe or kelly 122 and swivel 116 suspended from a support means 114. Packing sub 34 is connected to kelly 122 through an upper kellycock 118. Kelly 122 extends through a rotary table 124 and is connected to drill ring 18 by a lower kellycock 120 and saver sub 38. Powered rotation to rotary table 124 is supplied by a drill motor (not shown) on the derrick floor. When adding or removing pipe 14 from drill string 18, kelly 122, kellycock 120 and saver sub 38 are disconnected from drill string 18 in a conventional manner. Spring 62 in telescopic sub 32 will be preloaded to support member 82, packing sub 34, upper kellycock 118, kelly 122, lower kellycock 120, and saver sub 38.

As can be seen, my telescopic sub has three discrete positions. Each position corresponds to a different step of the tripping operation when drilling a well. This enables my sub to prevent impact damage both when connecting and disconnecting pipe to a drill string.

While only a single embodiment of my invention has been described, it will be understood various modifications can be made to my invention without departing from the spirit and scope of it. Therefore, the limits of my invention should be determined from the appended claims.

I claim:

1. A sub assembly including a telescopic sub positioned between upper and lower threaded pins, the lower pin for threadable connection to a drill pipe, the upper pin for threadable connection to a swivel, the telescopic sub comprising:

an annular inner sleeve and an annular sleeve outwardly spaced from said inner sleeve, said inner and outer sleeves being connected to the upper pin, said outer sleeve including a load bearing shoulder on its inner surface, a first chamber formed between said sleeves and the upper pin, an annular shiftable member disposed within said first chamber, the outer surface of said shiftable member including an annular surface, a piston and a recess, said annular surface having an outer diameter no greater than the inner diameter of said load bearing shoulder of said outer sleeve, said piston including a shoulder whose outer diameter is greater than the inner diameter of said load bearing shoulder of said outer sleeve, said piston being shiftably connected to said inner surface of said outer sleeve, said shoulder of said piston for engaging said shoulder of said outer sleeve when the lower pin is threadably connected to the drill pipe, said recess including an upper shoulder and an outer diameter less than said outer diameter of said annular surface, an annular shiftable retainer outwardly spaced from said outer sleeve, a second chamber formed between said retainer and said outer sleeve, a preloaded spring disposed in said second chamber, said spring preloaded with a force to support said shiftable member, the lower end of said retainer having an inner diameter less than said outer diameter of said annular surface, said lower end of said retainer for engaging said upper shoulder of said recess, wherein said piston is shiftable between normal, extended and compressed positions to prevent thread damage to the lower pin and the drill pipe when making and breaking connections between the sub assembly and the drill pipe.

2. A sub assembly as set forth in claim 1 wherein a retainer cap is connected to the upper end of said retainer.

3. A sub assembly as set forth in claim 1 wherein said lower end of said retainer includes a retainer cap.

4. A sub assembly as set forth in claim 1 wherein the outer surface of said outer sleeve includes a shoulder, a ring disposed in said second chamber below said spring, said ring having an inner diameter less than the outer diameter of said outer sleeve.

5. A sub assembly as set forth in claim 4 wherein a third chamber is formed below said ring, said ring including an orifice for communicating between said second and third chamber, said second and third chambers filled with a dampening fluid.

6. A sub assembly as set forth in claim 1 wherein said piston is midway between a lower stop surface of the upper pin and said load bearing shoulder of said outer sleeve when said piston is in said normal position.

7. A sub assembly as set forth in claim 1 wherein said inner sleeve is threadably connected to the lower portion of the upper pin.

8. A sub assembly as set forth in claim 1 wherein said outer sleeve is threadably connected to the lower portion of the upper pin.

9. A sub assembly including a telescopic sub positioned between upper and lower threaded pins, the lower pin for threadable connection to a drill pipe, the upper pin for threadable connection to a swivel, the telescopic sub comprising:

an annular inner sleeve and an annular sleeve outwardly spaced from said inner sleeve, said sleeves being threadably connected to the upper pin, said outer sleeve including a load bearing shoulder on its inner surface, a first chamber formed between said sleeves and the upper pin, an annular shiftable member disposed in said first chamber, the outer surface of said shiftable member including an annular surface, a piston, and a recess, said annular surface having an outer diameter no greater than the inner diameter of said load bearing shoulder of said outer sleeve, said piston including a shoulder whose outer diameter is greater than the inner diameter of said load bearing shoulder of said outer sleeve, said piston being shiftably connected to said inner surface of said outer sleeve, said shoulder of said piston for engaging said shoulder of said outer sleeve when the lower pin is threadably connected to the drill pipe, said recess including an upper shoulder and an outer diameter less than said outer diameter of said annular surface, an annular shiftable retainer outwardly spaced from said outer sleeve, a second chamber formed between said shiftable retainer and said outer sleeve, a preloaded spring disposed in said second chamber, said spring preloaded with a force to support said shiftable member, the lower end of said retainer having an inner diameter less than the outer diameter of said annular surface and positioned below said shoulder of said recess, said lower end of said retainer for engaging said upper shoulder of said recess, the outer surface of said outer sleeve including a shoulder, a ring disposed between said spring and said shoulder on said outer surface of said outer sleeve, said ring defining a third chamber and including an orifice for communicating said second chamber with said third chamber, said second and third chambers including a dampening fluid, wherein said piston is shiftable between normal, extended and compressed positions to prevent thread damage to the lower pin and the drill pipe when making and breaking connections between the sub assembly and the drill pipe.

* * * * *